US006890172B2

(12) United States Patent
Stephens et al.

(10) Patent No.: US 6,890,172 B2
(45) Date of Patent: May 10, 2005

(54) BURNER WITH FLUE GAS RECIRCULATION

(75) Inventors: George Stephens, Humble, TX (US); David B. Spicer, Houston, TX (US); Mark E. Bury, Acton, MA (US); Roberto O. Pellizzari, Groton, MA (US); Peter Loftus, Cambridge, MA (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 0 days.

(21) Appl. No.: 10/389,346

(22) Filed: Mar. 14, 2003

(65) Prior Publication Data

US 2003/0175643 A1 Sep. 18, 2003

Related U.S. Application Data

(60) Provisional application No. 60/365,145, filed on Mar. 16, 2002.

(51) Int. Cl.[7] ..... F23M 3/00

(52) U.S. Cl. ..... 431/9; 431/5; 126/91 A

(58) Field of Search ..... 431/9, 5, 115, 431/215; 126/91 A

(56) References Cited

U.S. PATENT DOCUMENTS 2,368,370 A 1/1945 Maxon
2,813,578 A 11/1957 Ferguson (Continued)

FOREIGN PATENT DOCUMENTS

CA 1169753 6/1984
DE 2944153 5/1981

(Continued)

OTHER PUBLICATIONS

Abstract of EP 0 507 233 published on Oct. 7, 1992, entitled "Burner for Liquid Fuels".

Straitz III, John F., et al., "Combat NOx With Better Burner Design," *Chemical Engineering,* Nov. 1994, pp. EE–4–EE–8.

Vahdati, M. M., et al., "Design And Development of A Low NOx Coanda Ejector Burner," *Journal of the Institute of Energy,* Mar. 2000, vol. 73, pp. 12–17.

(Continued)

*Primary Examiner*—Alfred Basichas
(74) *Attorney, Agent, or Firm*—Lucinda Lomas; Linda A. Kubena

(57) ABSTRACT

A burner for use in furnaces such as the type employed in steam cracking. The burner includes a primary air chamber, a burner tube including (i) a downstream end, (ii) an upstream end in fluid communication with the primary air chamber for receiving air, flue gas or mixtures thereof and fuel, and (iii) a burner tip mounted on the downstream end of the burner tube and directed to a first opening in the furnace, so that combustion of a combustible mixture including fuel and air takes place downstream of the burner tip, at least one flue gas recirculation duct having a first end at a second opening in the furnace and a second end opening into the primary air chamber, the at least one flue gas recirculation duct having at least one primary air channel in fluid communication with the at least one flue gas recirculation duct, and means for drawing flue gas from the furnace and primary air from a source of air, through the duct and into the primary air chamber, in response to an inspirating effect of uncombusted fuel flowing through the burner tube from its upstream end towards its downstream end. Optionally the flue gas recirculation duct has a plate member extending into the primary air chamber to create flow eddies to enhance further mixing of flue gas and air.

36 Claims, 5 Drawing Sheets

U.S. PATENT DOCUMENTS

| | | | | | |
|---|---|---|---|---|---|
| 2,918,117 | A | | 12/1959 | Griffin | |
| 2,983,312 | A | | 5/1961 | Finley et al. | |
| 3,880,570 | A | | 4/1975 | Marshall | |
| 4,004,875 | A | | 1/1977 | Zink et al. | |
| 4,089,629 | A | | 5/1978 | Baumgartner et al. | |
| 4,130,388 | A | | 12/1978 | Flanagan | |
| 4,230,445 | A | | 10/1980 | Janssen | |
| 4,257,763 | A | | 3/1981 | Reed | |
| 4,575,332 | A | | 3/1986 | Oppenberg et al. | |
| 4,629,413 | A | | 12/1986 | Michelson et al. | |
| 4,708,638 | A | | 11/1987 | Brazier et al. | |
| 4,739,713 | A | | 4/1988 | Vier et al. | |
| 4,748,919 | A | | 6/1988 | Campobenedetto et al. | |
| 4,815,966 | A | | 3/1989 | Janssen | |
| 4,828,483 | A | | 5/1989 | Finke | |
| 4,963,089 | A | | 10/1990 | Spielman | |
| 4,995,807 | A | | 2/1991 | Rampley et al. | |
| 5,044,931 | A | | 9/1991 | Van Eerden et al. | |
| 5,073,105 | A | | 12/1991 | Martin et al. | |
| 5,092,761 | A | | 3/1992 | Dinocolantonio | |
| 5,098,282 | A | | 3/1992 | Schwartz et al. | |
| 5,135,387 | A | | 8/1992 | Martin et al. | |
| 5,152,463 | A | | 10/1992 | Mao et al. | |
| 5,154,596 | A | | 10/1992 | Schwartz et al. | |
| 5,195,884 | A | | 3/1993 | Schwartz et al. | |
| 5,201,650 | A | | 4/1993 | Johnson | |
| 5,224,851 | A | | 7/1993 | Johnson | |
| 5,238,395 | A | | 8/1993 | Schwartz et al. | |
| 5,254,325 | A | * | 10/1993 | Yamasaki et al. | 423/450 |
| 5,263,849 | A | | 11/1993 | Irwin et al. | |
| 5,269,679 | A | | 12/1993 | Syska et al. | |
| 5,275,554 | A | | 1/1994 | Faulkner | |
| 5,284,438 | A | | 2/1994 | McGill et al. | |
| 5,299,930 | A | | 4/1994 | Weidman | |
| 5,316,469 | A | | 5/1994 | Martin et al. | |
| 5,326,254 | A | | 7/1994 | Munk | |
| 5,344,307 | A | | 9/1994 | Schwartz et al. | |
| 5,350,293 | A | | 9/1994 | Khinkis et al. | |
| 5,370,526 | A | | 12/1994 | Buschulte et al. | |
| 5,407,345 | A | | 4/1995 | Robertson et al. | |
| 5,413,477 | A | | 5/1995 | Moreland | |
| 5,470,224 | A | | 11/1995 | Bortz | |
| 5,472,341 | A | | 12/1995 | Meeks | |
| 5,542,839 | A | | 8/1996 | Kelly | |
| 5,562,438 | A | | 10/1996 | Gordon et al. | |
| 5,584,684 | A | | 12/1996 | Dobbeling et al. | |
| 5,603,906 | A | | 2/1997 | Lang et al. | |
| 5,611,682 | A | | 3/1997 | Slavejkov et al. | |
| 5,624,253 | A | | 4/1997 | Sulzhik et al. | |
| 5,685,707 | A | | 11/1997 | Ramsdell et al. | |
| 5,688,115 | A | * | 11/1997 | Johnson | 431/9 |
| 5,807,094 | A | | 9/1998 | Sarv | |
| 5,813,846 | A | * | 9/1998 | Newby et al. | 431/9 |
| 5,980,243 | A | | 11/1999 | Surbey et al. | |
| 5,984,665 | A | | 11/1999 | Loftus et al. | |
| 5,987,875 | A | | 11/1999 | Hilburn et al. | |
| 5,993,193 | A | | 11/1999 | Loftus et al. | |
| 6,007,325 | A | | 12/1999 | Loftus et al. | |
| 6,056,538 | A | | 5/2000 | Büchner et al. | |
| 6,332,408 | B2 | | 12/2001 | Howlett et al. | |
| 6,347,935 | B1 | | 2/2002 | Schindler et al. | |
| 6,383,462 | B1 | * | 5/2002 | Lang | 423/235 |
| 6,616,442 | B2 | | 9/2003 | Venizelos et al. | |

FOREIGN PATENT DOCUMENTS

| | | |
|---|---|---|
| DE | 3232421 | 3/1984 |
| DE | 3818265 | 11/1989 |
| EP | 0099828 | 6/1988 |
| EP | 0 347 956 | 12/1989 |
| EP | 0 374 423 | 6/1990 |
| EP | 0 408 171 A1 | 1/1991 |
| EP | 0 507 233 | 10/1992 |
| EP | 0 620 402 A1 | 10/1994 |
| EP | 0 674 135 B2 | 9/1995 |
| EP | 0 751 343 | 1/1997 |
| EP | 0486169 | 1/1998 |
| EP | 1096202 | 2/2001 |
| EP | 1 211 458 | 6/2002 |
| FR | 2629900 | 10/1988 |
| SU | 374488 | 3/1973 |

OTHER PUBLICATIONS

Bussman, Wes, et al., "Low NOx Burner Technology for Ethylene Cracking Furnaces," presented at the *2001 AIChE Spring National Meeting, 13th Annual Ethylene Producers Conference,* Houston, TX, Apr. 25, 2001, pp. 1–23.

Seebold, James G., "Reduce Heater NOx in the Burner," *Hydrocarbon Processing,* Nov. 1982, pp. 183–186.

"West Germany's Caloric Develops a Low–NOx Recycling Fuel Burner," *Chemical Engineering,* Oct. 4, 1982, p. 17.

Chemical Engineering Progress, vol. 43, 1947, "The Design of Jet Pumps" by A. Edgar Kroll, pp. 21–24, vol. 1, No. 2.

* cited by examiner

FIG. 3
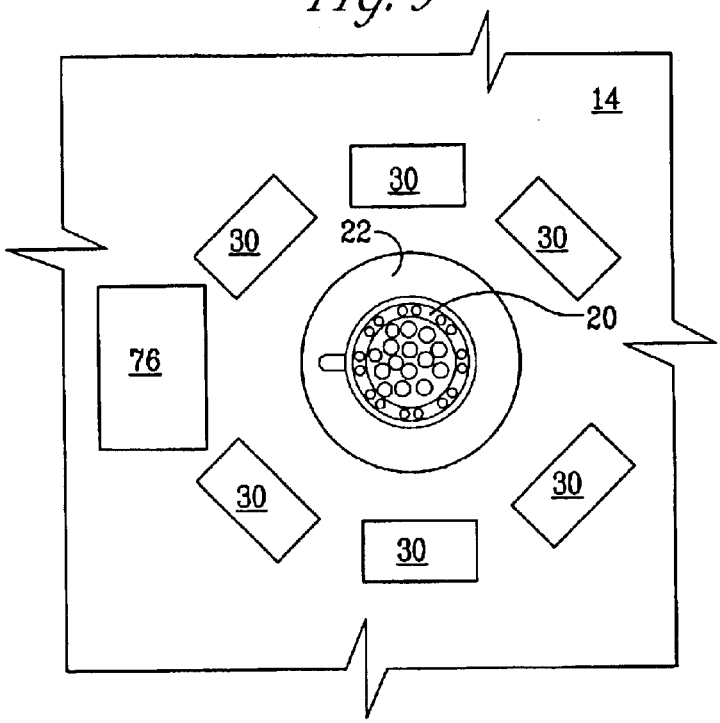
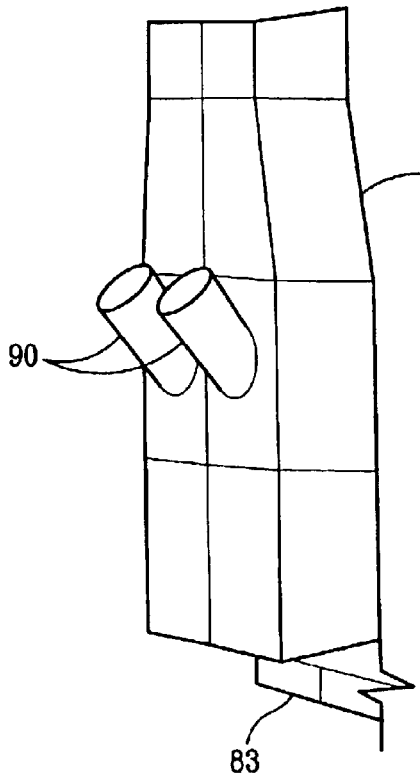
FIG. 4

BURNER WITH FLUE GAS RECIRCULATION

RELATED APPLICATIONS

This patent application claims priority from Provisional Application Ser. No. 60/365,145, filed on Mar. 16, 2002, the contents of which are hereby incorporated by reference.

FIELD OF THE INVENTION

This invention relates to improvements in a flue-gas-recirculation (FGR) burner such as those employed in high temperature furnaces in the steam cracking of hydrocarbons. More particularly, the invention relates to an FGR burner employing structures for improving mixing of primary air and recirculated flue gas to thereby reduce $NO_x$.

BACKGROUND OF THE INVENTION

As a result of the interest in recent years to reduce the emission of pollutants from burners used in large industrial furnaces, burner design has undergone substantial change. In the past, improvements in burner design were aimed primarily at improving heat distribution. Increasingly stringent environmental regulations have shifted the focus of burner design to the minimization of regulated pollutants.

Oxides of nitrogen ($NO_x$) are formed in air at high temperatures. Reduction of $NO_x$ emissions is a desired goal to decrease air pollution and meet government regulations. In recent years, a wide variety of mobile and stationary sources of $NO_x$ emissions have come under increased scrutiny and regulation.

A strategy for achieving lower $NO_x$ emission levels is to install a $NO_x$ reduction catalyst to treat the furnace exhaust stream. This strategy, known as Selective Catalytic Reduction (SCR), is very costly and, although it can be effective in meeting more stringent regulations, represents a less desirable alternative to improvements in burner design.

Burners used in large industrial furnaces may use either liquid fuel or gas. Liquid fuel burners mix the fuel with steam prior to combustion to atomize the fuel to enable more complete combustion, and combustion air is mixed with the fuel at the zone of combustion.

Gas fired burners can be classified as either premix or raw gas, depending on the method used to combine the air and fuel. They also differ in configuration and the type of burner tip used. Raw gas burners inject fuel directly into the air stream, and the mixing of fuel and air occurs simultaneously with combustion. Since airflow does not change appreciably with fuel flow, the air register settings of natural draft burners must be changed after firing rate changes. Therefore, frequent adjustment may be necessary, as explained in detail in U.S. Pat. No. 4,257,763, which patent is incorporated herein by reference. In addition, many raw gas burners produce luminous flames.

Premix burners mix the fuel with some or all of the combustion air prior to combustion. Since premixing is accomplished by using the energy present in the fuel stream, airflow is largely proportional to fuel flow. As a result, therefore, less frequent adjustment is required. Premixing the fuel and air also facilitates the achievement of the desired flame characteristics. Due to these properties, premix burners are often compatible with various steam cracking furnace configurations.

Floor-fired premix burners are used in many steam crackers and steam reformers primarily because of their ability to produce a relatively uniform heat distribution profile in the tall radiant sections of these furnaces. Flames are non-luminous, permitting tube metal temperatures to be readily monitored. Therefore, a premix burner is the burner of choice for such furnaces. Premix burners can also be designed for special heat distribution profiles or flame shapes required in other types of furnaces.

In gas fired industrial furnaces, $NO_x$ is formed by the oxidation of nitrogen drawn into the burner with the combustion air stream. The formation of $NO_x$ is widely believed to occur primarily in regions of the flame where there exist both high temperatures and an abundance of oxygen. Since ethylene furnaces are amongst the highest temperature furnaces used in the hydrocarbon processing industry, the natural tendency of burners in these furnaces is to produce high levels of $NO_x$ emissions.

One technique for reducing $NO_x$ that has become widely accepted in industry is known as staging. With staging, the primary flame zone is deficient in either air (fuel-rich) or fuel (fuel-lean). The balance of the air or fuel is injected into the burner in a secondary flame zone or elsewhere in the combustion chamber. As is well known, a fuel-rich or fuel-lean combustion zone is less conducive to $NO_x$ formation than an air-fuel ratio closer to stoichiometry. Staging results in reducing peak temperatures in the primary flame zone and has been found to alter combustion speed in a way that reduces $NO_x$. Since $NO_x$ formation is exponentially dependent on gas temperature, even small reductions in peak flame temperature can dramatically reduce $NO_x$ emissions. However this must be balanced with the fact that radiant heat transfer decreases with reduced flame temperature, while CO emissions, an indication of incomplete combustion, may actually increase as well.

In the context of premix burners, the term primary air refers to the air premixed with the fuel; secondary, and in some cases tertiary, air refers to the balance of the air required for proper combustion. In raw gas burners, primary air is the air that is more closely associated with the fuel; secondary and tertiary air is more remotely associated with the fuel. The upper limit of flammability refers to the mixture containing the maximum fuel concentration (fuel-rich) through which a flame can propagate.

Thus, one set of techniques achieves lower flame temperatures by using staged-air or staged-fuel burners to lower flame temperatures by carrying out the initial combustion at far from stoichiometric conditions (either fuel-rich or air-rich) and adding the remaining air or fuel only after the flame has radiated some heat away to the fluid being heated in the furnace.

Another set of techniques achieves lower flame temperatures by diluting the fuel-air mixture with inert material. Flue-gas (the products of the combustion reaction) or steam are commonly used diluents. Such burners are classified as FGR (flue-gas-recirculation) or steam-injected, respectively.

U.S. Pat. No. 5,092,761 discloses a method and apparatus for reducing $NO_x$ emissions from premix burners by recirculating flue gas. Flue gas is drawn from the furnace through a pipe or pipes by the inspirating effect of fuel gas and combustion air passing through a venturi portion of a burner tube. The flue gas mixes with combustion air in a primary air chamber prior to combustion to dilute the concentration of $O_2$ in the combustion air, which lowers flame temperature and thereby reduces $NO_x$ emissions. The contents of U.S. Pat. No. 5,092,761 are incorporated herein by reference.

Analysis of burners of the type described in U.S. Pat. No. 5,092,761 has indicated the flue-gas-recirculation (FGR)

ratio is generally in the range 5–10% where FGR ratio is defined as:

FGR ratio (%)=100[G/(F+A)]

where G=Flue-gas drawn into venturi, (lb),

F=Fuel combusted in burner, (lb), and

A=Air drawn into burner, (lb).

The ability of these burners to generate higher FGR ratios is limited by the inspirating capacity of the fuel orifice/venturi combination. Further closing of the primary air dampers will produce lower pressures in the primary air chamber and thus enable increased FGR ratios. However, the flow of primary air may be reduced such that insufficient oxygen exists in the venturi for acceptable burner stability.

Therefore, what is needed is a burner for the combustion of fuel gas wherein a higher level of FGR may be achieved while maintaining a sufficient oxygen flow to provide acceptable burner stability. The higher FGR will yield further reductions in $NO_x$ emissions.

SUMMARY OF THE INVENTION

The present invention is directed to a burner for use in furnaces such as in steam cracking. The burner includes a primary air chamber; a burner tube including (i) a downstream end, (ii) an upstream end in fluid communication with the primary air chamber for receiving air, flue gas or mixtures thereof and fuel, and (iii) a burner tip mounted on the downstream end of the burner tube and directed to a first opening in the furnace, so that combustion takes place downstream of the burner tip; at least one flue gas recirculation duct having a first end at a second opening in the furnace and a second end opening into an air chamber of the burner; the at least one flue gas recirculation duct having at least one primary air channel in fluid communication with the at least one flue gas recirculation duct; and means for drawing flue gas from the furnace and primary air from a source of air, through the duct and into an air chamber of the burner, in response to an inspirating effect of uncombusted fuel flowing through the burner tube from its upstream end towards its downstream end.

In another aspect of the present invention, a burner for the combustion of fuel for use in a furnace is provided which includes a primary air chamber, a burner tube including (i) a downstream end, (ii) an upstream end in fluid communication with the primary air chamber for receiving fuel and air, flue gas or mixtures thereof, and (iii) a burner tip mounted on the downstream end of the burner tube and directed to a first opening in the furnace, so that combustion takes place downstream of the burner tip, and at least one flue gas recirculation duct having a first end at a second opening in the furnace and a second end opening into the primary air chamber of the burner; the flue gas recirculation duct having a plate member extending into the primary air chamber, whereby flow eddies are created to enhance mixing of flue gas and air.

Also provided is a method for improving the mixing of flue gas and air in a burner for the combustion of fuel. The burner including a primary air chamber; a burner tube including (i) a downstream end, (ii) an upstream end in fluid communication with the primary air chamber for receiving fuel and air, flue gas or mixtures thereof, and (iii) a burner tip mounted on the downstream end of the burner tube and directed to a first opening in the furnace, so that combustion takes place downstream of the burner tip and at least one flue gas recirculation duct having a first end at a second opening in the furnace and a second end opening into the primary air chamber of the burner. The method includes the step of creating flow eddies to enhance mixing of flue gas and air through the use of a plate member extending into the primary air chamber from the second end of the at least one flue gas recirculation duct.

BRIEF DESCRIPTION OF THE DRAWINGS

The invention is further explained in the description that follows with reference to the drawings illustrating, by way of non-limiting examples, various embodiments of the invention wherein:

FIG. 3 is a plan view taken along line 3—3 of FIG. 1;

FIG. 4 is a perspective view of an embodiment of a flue gas recirculation duct in accordance with the instant invention;

DETAILED DESCRIPTION OF THE SPECIFIC EMBODIMENTS

Figure 1:
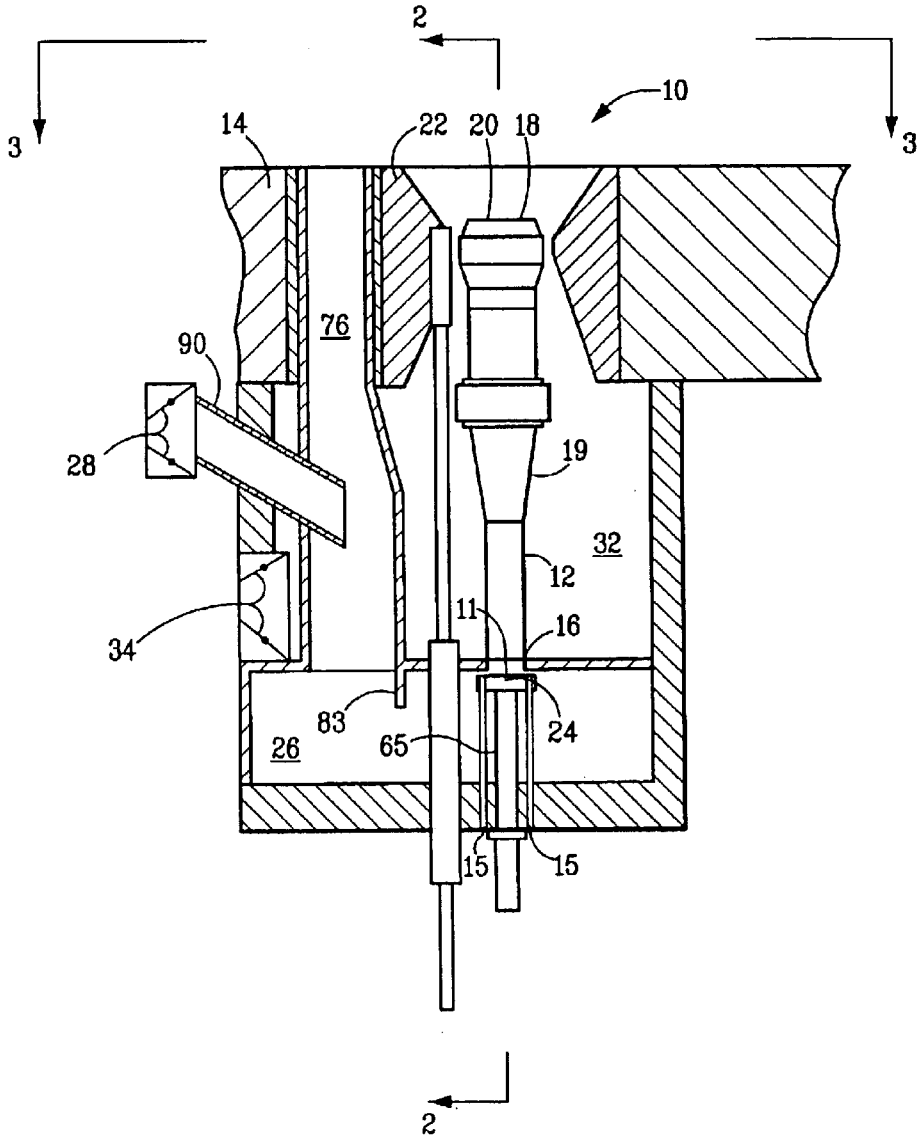
FIG. 1 illustrates an elevation partly in section of an embodiment of the burner in accordance with the present invention.
Figure 2:
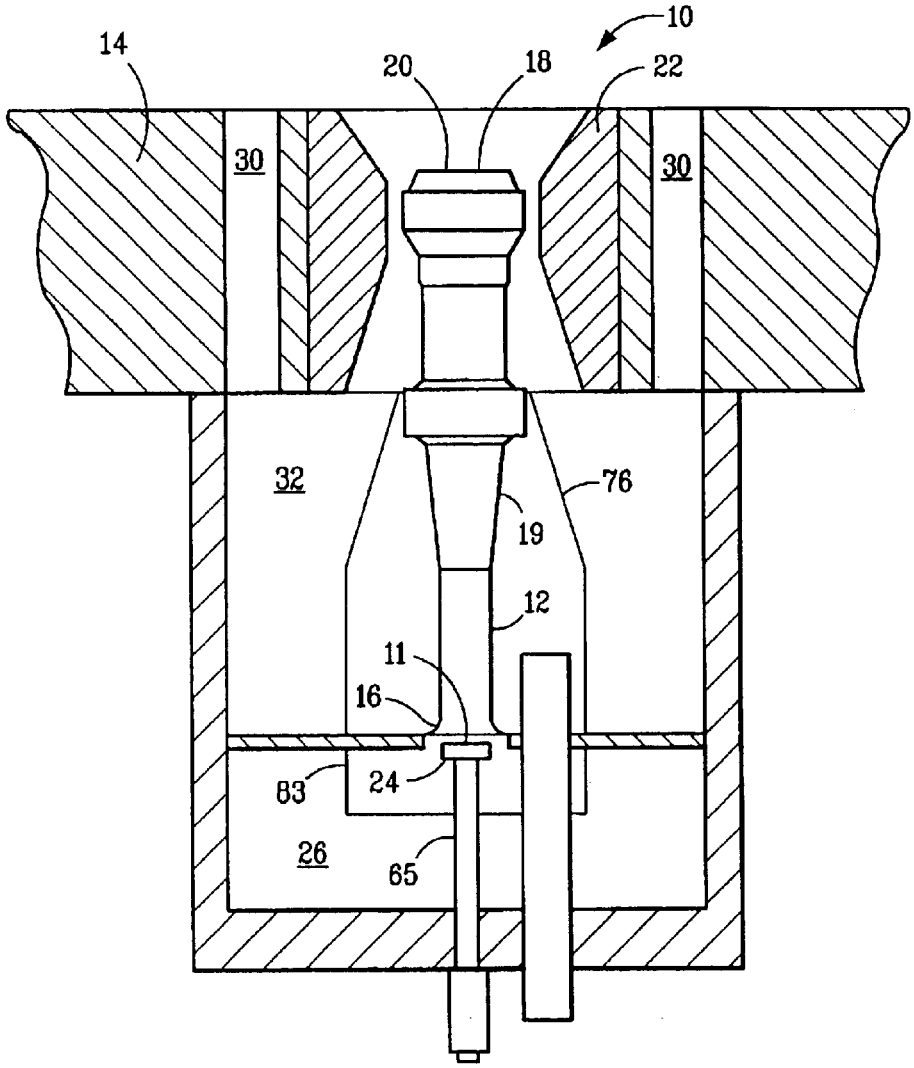
FIG. 2 is an elevation partly in section taken along line 2—2 of FIG. 1.

Although the present invention is described in terms of a burner for use in connection with a furnace or an industrial furnace, it will be apparent to one of skill in the art that the teachings of the present invention also have applicability to other process components such as, for example, boilers. Thus, the term furnace herein shall be understood to mean furnaces, boilers and other applicable process components.

Referring to FIGS. 1–4, a burner 10 includes a freestanding burner tube 12 located in a well in a furnace floor 14. The burner tube 12 includes an upstream end 16, a downstream end 18 and a venturi portion 19. A burner tip 20 is located at the downstream end 18 and is surrounded by an annular tile 22. A fuel orifice 11, which may located within gas spud 24, is at the top end of a gas fuel riser 65 and is located at the upstream end 16 and introduces fuel gas into the burner tube 12. Fresh or ambient air is provided to the at least one passageway or FGR duct 76 through adjustable dampers 28 and a pair of primary air channels or tubes 90 to mix with the flue gas in passageway or duct 76 for subsequent mixing with fuel gas at the upstream end 16 of the burner tube 12. The mixture then passes upwardly through the venturi portion 19. Combustion of the fuel gas and air occurs downstream of the burner tip 20. Burner 10 may further include steam injection tube 15, which serves to lower $NO_x$ emissions and enhance mass flow through venturi 19, as is known to those of skill in the art.

A plurality of air ports 30 (FIGS. 2 and 3) originate in a secondary air chamber 32 and pass through the furnace floor 14 into the furnace. Fresh or ambient air enters the secondary air chamber 32 through adjustable dampers 34 and passes through the staged air ports 30 into the furnace to provide secondary or staged combustion, as described in U.S. Pat. No. 4,629,413, which is hereby incorporated herein by reference.

Unmixed low temperature fresh or ambient air, having entered the secondary air chamber 32 through the dampers 34, and having passed through the air ports 30 into the furnace, is also drawn through a flue gas recirculation. (FGR) duct 76 into a primary air chamber 26 by the inspirating effect of the fuel gas passing through the venturi portion 19. The duct 76 is shown as a metallic FGR duct.

The mixing of the fresh or ambient air with the flue gas lowers the temperature of the hot flue gas flowing through the duct 76 and thereby substantially increases the life of the duct 76 and allows use of this type burner to reduce $NO_x$ emission in high temperature cracking furnaces having flue gas temperature above 1900° F. in the radiant section of the furnace.

Mixing is promoted by providing two or more primary air channels 90 protruding into the FGR duct 76. The channels 90 are conic-section, cylindrical, or squared and a gap between each channel 90 produces a turbulence zone in the duct 76 where good flue gas/air mixing occurs.

The geometry of channels 90 are designed to promote mixing by increasing air momentum into the FGR duct. The velocity of the air is optimized by reducing the total flow area of the primary air channels 90 to a level that still permits sufficient primary air to be available for combustion, as those skilled in the art are capable of determining through routine trials.

Mixing is further enhanced by a plate member 83 at the lower end of the inner wall of the FGR duct 76. The plate member 83 extends into the primary air chamber or plenum 26. Flow eddies are created by flow around the plate of the mixture of flue gas and air. The flow eddies provide further mixing of the flue gas and air. The plate member 83 also makes the FGR duct 76 effectively longer, and a longer FGR duct also promotes better mixing.

The improvement in the amount of mixing between the recirculated flue gas and the primary air caused by the channels 90 and the plate member 83 raises the capacity to inspirate FGR. Better mixing results in a higher capacity of the burner to inspirate flue gas recirculation and a more homogeneous mixture inside the venturi portion 19. Higher flue gas recirculation reduces overall flame temperature by providing a heat sink for the energy released from combustion. Better mixing in the venturi portion 19 tends to reduce the hot-spots that occur as a result of localized high oxygen regions.

Flue gas containing, for example, 0 to about 15% $O_2$ is drawn from near the furnace floor through the duct 76 with about 5 to about 15% $O_2$ preferred, about 2 to about 10% $O_2$ more preferred and about 2 to about 5% $O_2$ particularly preferred, by the inspirating effect of fuel gas passing through venturi portion 19 of burner tube 12, and, as indicated above, mixed with primary air in duct 76 and further in primary air chamber 26, which is prior to the zone of combustion. Therefore, the amount of inert material mixed with the fuel is raised, thereby reducing the flame temperature and, as a result, reducing $NO_x$ emissions. This is in contrast to a liquid fuel burner, such as that of U.S. Pat. No. 2,813,578, in which the combustion air is mixed with the fuel at the zone of combustion, rather than prior to the zone of combustion.

As may be appreciated, closing or partially closing damper 28 restricts the amount of fresh air that can be drawn into the primary air chamber 26 and thereby provides the vacuum necessary to draw flue gas from the furnace floor.

Advantageously, a mixture of from about 20% to about 80% flue gas and from about 20% to about 80% ambient air should be drawn through duct 76. It is particularly preferred that a mixture of about 50% flue gas and about 50% ambient air be employed. The desired proportions of flue gas and ambient air may be achieved by proper placement and/or design of the duct 76 in relation to the air ports 30. That is, the geometry of the air ports, including but not limited to their distance from the burner tube, the number of air ports, and the size of the air ports, may be varied to obtain the desired percentages of flue gas and ambient air.

Figure 5:
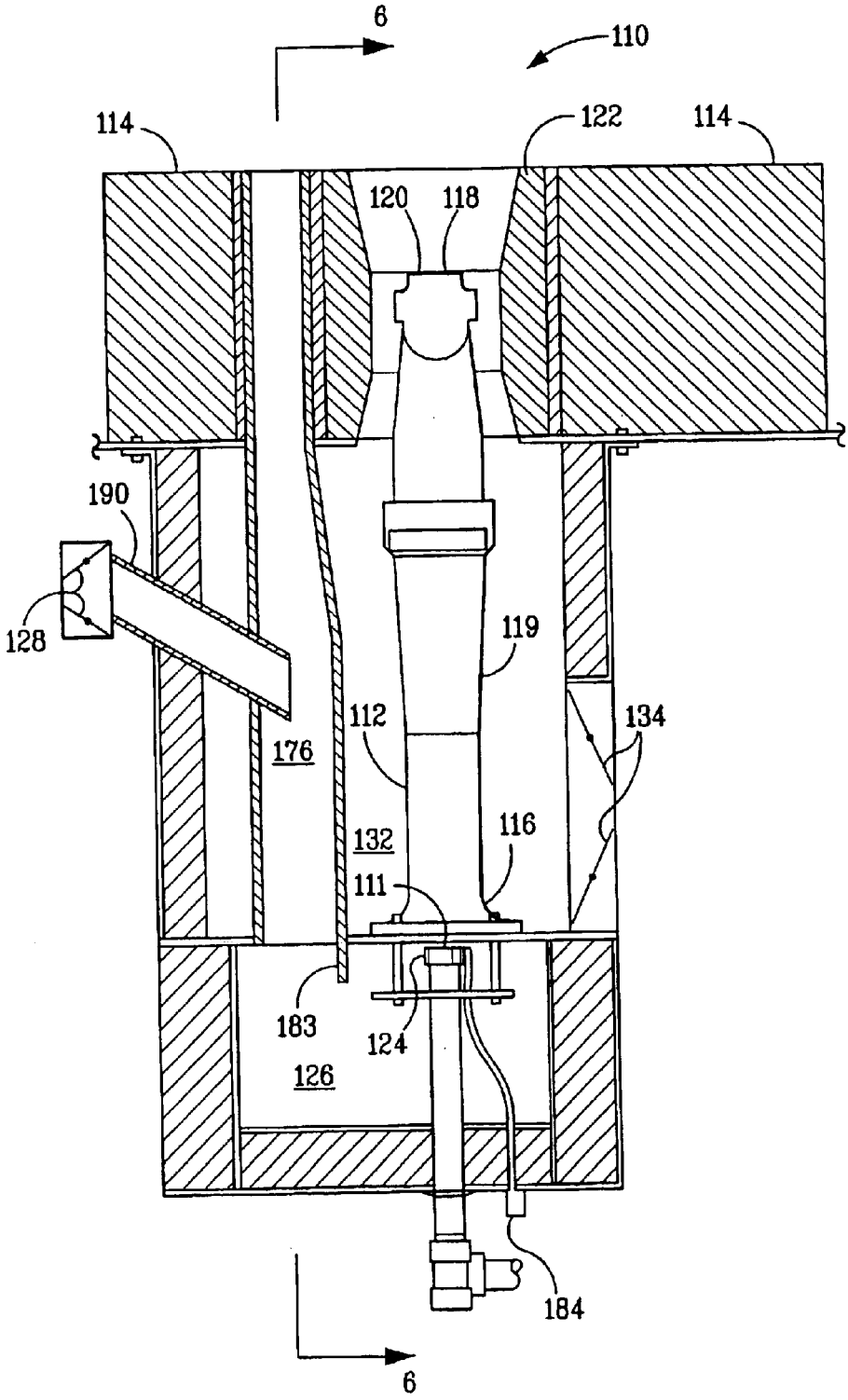
FIG. 5 illustrates an elevation partly in section of an embodiment of a flat-flame burner of the present invention.
Figure 6:
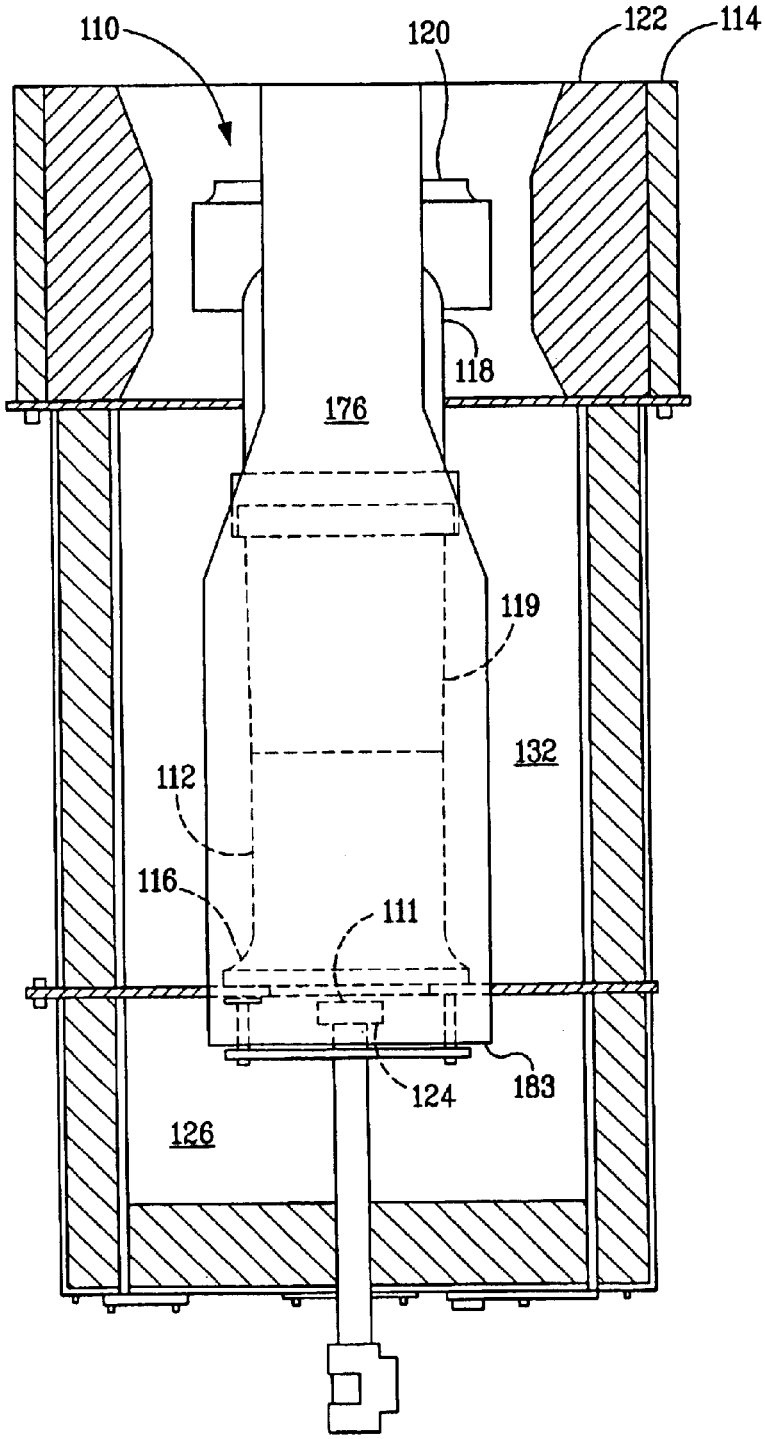
FIG. 6 is an elevation partly in section of the embodiment of a flat-flame burner of FIG. 5 taken along line 6—6 of FIG. 5.

The flue gas recirculation teachings disclosed herein can alternatively be applied in flat-flame burners, as will now be described by reference to FIGS. 5 and 6.

A burner 110 includes a freestanding burner tube 112 located in a well in a furnace floor 114. Burner tube 112 includes an upstream end 116, a downstream end 118 and a venturi portion 119. Burner tip 120 is located at downstream end 118 and is surrounded by a peripheral tile 122. A fuel orifice 111, which may be located within gas spud 124, is located at upstream end 116 and introduces fuel gas into burner tube 112. Fresh or ambient air may be introduced into primary air chamber 126 to mix with the fuel gas at upstream end 116 of burner tube 112. Combustion of the fuel gas and fresh air occurs downstream of burner tip 120. Fresh secondary air enters secondary chamber 132 through dampers 134.

In order to recirculate flue gas from the furnace to the primary air chamber, a flue gas recirculation passageway 176 is formed in furnace floor 114 and extends to primary air chamber 126, so that flue gas is mixed with fresh air drawn into the primary air chamber through dampers 128. Flue gas containing, for example, 0 to about 15% $O_2$ is drawn through passageway 176 by the inspirating effect of fuel gas passing through venturi portion 119 of burner tube 112. Primary air and flue gas are mixed in primary air chamber 126, which is prior to the zone of combustion.

In operation, a fuel orifice 111, which may be, located within gas spud 124, discharges fuel into burner tube 112, where it mixes with primary air, recirculated flue-gas or mixtures thereof. The mixture of fuel gas, recirculated flue-gas, and primary air then discharges from burner tip 120. The mixture in the venturi portion 119 of burner tube 112 is maintained below the fuel-rich flammability limit; i.e., here is insufficient air in the venturi to support combustion. Secondary air is added to provide the remainder of the air required for combustion. The majority of the secondary air is added a finite distance away from the burner tip 120.

As with the previous embodiment, mixing is promoted by providing two or more primary air channels 190 protruding into the FGR duct 176. The channels 190 are conic-section, cylindrical, or squared and a gap between each channel 190 produces a turbulence zone in the duct 176 where good flue gas/air mixing occurs.

The geometry of the channels 190 are designed to promote mixing by increasing air momentum into the FGR duct. The velocity of the air is optimized by reducing the total flow area of the primary air channels 190 to a level that still permits sufficient primary air to be available for combustion, as those skilled in the art are capable of determining through routine trials.

In this embodiment, mixing may be further enhanced by a plate member 183 at the lower end of the inner wall of the FGR duct 176. The plate member 183 extends into the primary air chamber 126. Flow eddies are created by flow around the plate of the mixture of flue gas and air. The flow eddies provide further mixing of the flue gas and air. The plate member 183 also makes the FGR duct 176 effectively longer, and a longer FGR duct also promotes better mixing.

Optionally, one or more steam injection tubes 184 may be provided so as to be positioned in the direction of flow so as to add to the motive force provided by venturi portion 119 for inducing the flow of fuel, steam and flue gas, air and mixtures thereof into the burner tube 112.

Although the burners of this invention have been described in connection with floor-fired hydrocarbon cracking furnaces, they may also be used in furnaces for carrying out other reactions or functions.

Thus, it can be seen that, by use of this invention, $NO_x$ emissions may be reduced in a burner without the use of fans or replacement burners. The flue gas recirculation system of the invention can be retrofitted to existing burners.

In addition to the use of flue gas as a diluent, another technique to achieve lower flame temperature through dilution is through the use of steam injection. Steam can be injected in the primary air or the secondary air chamber. Preferably, steam may be injected upstream of the venturi.

It will also be understood that the teachings described herein also have utility in raw gas burners having a pre-mix burner configuration wherein flue gas alone is mixed with fuel gas at the entrance to the burner tube. In fact, it has been found that the pre-mix, staged-air burners of the type described in detail herein can be operated with the primary air damper doors closed, with very satisfactory results.

Although the invention has been described with reference to particular means, materials and embodiments, it is to be understood that the invention is not limited to the particulars disclosed and extends to all equivalents within the scope of the claims.

What is claimed is:

1. A burner for the combustion of fuel for use in a furnace, comprising:

(a) a primary air chamber;

(b) a burner tube including (i) a downstream end, (ii) an upstream end for receiving air, flue gas and mixtures thereof and fuel, and (iii) a burner tip mounted on the downstream end of said burner tube and directed to a first opening in the furnace, so that combustion takes place downstream of said burner tip;

(c) at least one flue gas recirculation duct having a first end at a second opening in the furnace and a second end opening into said primary air chamber; said at least one flue gas recirculation duct having at least one primary air channel in fluid communication with said at least one flue gas recirculation duct; and (d) means for drawing flue gas from said furnace and primary air from a source of air, through said duct and into said primary air chamber in response to an inspirating effect of uncombusted fuel flowing through said burner tube from its upstream end towards its downstream end.

2. The burner according to claim 1, wherein said burner is a pre-mix burner.

3. The burner according to claim 1, wherein said burner is a flat-flame burner.

4. The burner according to claim 1, wherein said fuel comprises fuel gas.

5. The burner according to claim 1, further comprising at least one steam injection tube.

6. The burner according to claim 1, wherein said means for drawing flue gas from said furnace comprises a venturi portion in said burner tube.

7. The burner according to claim 1, further comprising at least one first adjustable damper to restrict the amount of air entering into said at least one primary air channel.

8. The burner according to claim 1, further comprising two primary air channels in fluid communication with said at least one flue gas recirculation duct.

9. The burner according to claim 1, further comprising a secondary air chamber, and at least one adjustable damper opening into said secondary air chamber to restrict the amount of air entering into said secondary air chamber, said secondary air chamber being in fluid communication with at least one air opening, said at least one air opening positioned adjacent to said first opening in the furnace.

10. The burner according to claim 9, wherein said secondary air chamber is in fluid communication with a plurality of said at least one air opening.

11. The burner according to claim 1, wherein said flue gas recirculation duct extends from said primary air chamber.

12. The burner according to claim 11, wherein said flue gas recirculation duct extents vertically from said primary air chamber.

13. The burner according to claim 1, further comprising at least two primary air channels protruding into said flue gas recirculation duct, said primary air channels having a gap therebetween to produce a turbulence zone in said flue gas recirculation duct.

14. The burner according to claim 13, wherein said primary air channels are substantially cylindrical.

15. The burner according to claim 1, wherein said flue gas recirculation duct has a plate member extending into said primary air chamber, whereby flow eddies are created to enhance further mixing of the flue gas and air.

16. The burner according to claim 15, further comprising a fuel orifice located adjacent the upstream end of said burner tube, for introducing fuel gas into said burner tube.

17. The burner according to claim 16 wherein said fuel orifice is located within a gas spud.

18. The burner according to claim 17, further comprising a gas riser, wherein said gas spud is mounted on said gas riser.

19. The burner according to claim 13, further comprising a gas spud located adjacent the upstream end of said burner tube, for introducing fuel gas into said burner tube.

20. The burner according to claim 19, further comprising a gas riser, wherein said gas spud is mounted on said gas riser.

21. The burner according to claim 9, further comprising a gas spud located adjacent the upstream end of said burner tube, for introducing fuel gas into said burner tube.

22. The burner according to claim 21, further comprising a gas riser, wherein said gas spud is mounted on said gas riser.

23. The burner according to claim 6, further comprising a gas spud located adjacent the upstream end of said burner tube, for introducing fuel gas into said burner tube.

24. The burner according to claim 23, further comprising a gas riser, wherein said gas spud is mounted on said gas riser.

25. The burner according to claim 1, further comprising a gas spud located adjacent the upstream end of said burner tube, for introducing fuel gas into said burner tube.

26. The burner according to claim 25, further comprising a gas riser, wherein said gas spud is mounted on said gas riser.

27. A burner for the combustion of fuel for use in a furnace, comprising:

(a) a primary air chamber;

(b) a burner tube including (i) a downstream end, (ii) an upstream end in fluid communication with said primary air chamber for receiving fuel and air, flue gas or mixtures thereof, and (iii) a burner tip mounted on the downstream end of said burner tube and directed to a first opening in the furnace, so that combustion takes place downstream of said burner tip; and (c) at least one flue gas recirculation duct having a first end at a second opening in the furnace and a second end opening into said primary air chamber of said burner; said flue gas recirculation duct having a plate member extending into said primary air chamber, whereby flow eddies are created to enhance mixing of flue gas and air.

28. The burner according to claim 27, wherein said burner is a pre-mix burner.

29. The burner according to claim 27, wherein said burner is a flat-flame burner.

30. The burner according to claim 27, wherein said fuel comprises fuel gas.

31. The burner according to claim 27, further comprising at least one steam injection tube.

32. A method for improving the mixing of flue gas and air in a burner for the combustion of fuel, the burner including a primary air chamber; a burner tube including (i) a downstream end, (ii) an upstream end in fluid communication with the primary air chamber for receiving fuel and air, flue gas or mixtures thereof, and (iii) a burner tip mounted on the downstream end of the burner tube and directed to a first opening in the furnace, so that combustion takes place downstream of the burner tip and at least one flue gas recirculation duct having a first end at a second opening in the furnace and a second end opening into the primary air chamber of the burner, the method comprising the step of:

creating flow eddies to enhance mixing of flue gas and air through the use of a plate member extending into the primary air chamber from the second end of the at least one flue gas recirculation duct.

33. The method according to claim 32, wherein the burner is a pre-mix burner.

34. The method according to claim 32, wherein the burner is a flat-flame burner.

35. The method according to claim 32, wherein the fuel comprises fuel gas.

36. The method according to claim 32, further comprising the step of injecting steam through at least one steam injection tube.

* * * * *